US012426638B2

(12) United States Patent
Thornton et al.

(10) Patent No.: US 12,426,638 B2
(45) Date of Patent: Sep. 30, 2025

(54) AEROSOLIZABLE MATERIAL FOR INSERTION INTO AN AEROSOL PROVISION DEVICE

(71) Applicant: Nicoventures Trading Limited, London (GB)

(72) Inventors: Andrew Thornton, London (GB); Patrick Moloney, London (GB); Karl Kaljura, London (GB)

(73) Assignee: Nicoventures Trading Limited, London (GB)

( * ) Notice: Subject to any disclaimer, the term of this patent is extended or adjusted under 35 U.S.C. 154(b) by 270 days.

(21) Appl. No.: 17/779,500

(22) PCT Filed: Nov. 25, 2020

(86) PCT No.: PCT/EP2020/083420
§ 371 (c)(1),
(2) Date: May 24, 2022

(87) PCT Pub. No.: WO2021/105242
PCT Pub. Date: Jun. 3, 2021

(65) Prior Publication Data

US 2023/0032298 A1 Feb. 2, 2023

(30) Foreign Application Priority Data

Nov. 25, 2019 (GB) ..... 1917125

(51) Int. Cl.
*A24F 40/48* (2020.01)
*A24F 40/20* (2020.01)
(Continued)

(52) U.S. Cl.
CPC ..... *A24F 40/485* (2020.01); *A24F 40/20* (2020.01); *A24F 40/51* (2020.01); *A24F 40/60* (2020.01)

(58) Field of Classification Search
CPC ..... A24F 40/485; A24F 40/20; A24F 40/51; A24F 40/60; A24F 40/42; A24F 40/50; A24F 40/53
See application file for complete search history.

(56) References Cited

U.S. PATENT DOCUMENTS

2009/0266358 A1 10/2009 Sacristan et al.
2013/0213420 A1* 8/2013 Hon ..... A61M 11/044 131/329
(Continued)

FOREIGN PATENT DOCUMENTS

JP 2010507750 A 3/2010
JP 2014522650 A 9/2014
(Continued)

OTHER PUBLICATIONS

International Search Report and Written Opinion for Application No. PCT/EP2020/083420, mailed on Feb. 15, 2021, 10 pages.
(Continued)

*Primary Examiner* — Truc T Nguyen
(74) *Attorney, Agent, or Firm* — Merchant & Gould P.C.

(57) ABSTRACT

An aerosol provision device for heating aerosolisable material to produce an aerosol, including a heating chamber configured to receive aerosolisable material having an inlet and an outlet, an inlet valve associated with the inlet, and an outlet valve associated with the outlet, the inlet valve and the outlet valves moveable from a first configuration to a second configuration responsive to a change in a property of the heating chamber, such that in the first configuration the inlet valve and the outlet valves are arranged to seal the inlet and the outlet to substantially prevent gaseous flow through the inlet and the outlet, and in the second configuration the inlet valve and the outlet valve are arranged to allow gaseous flow through the inlet and outlet.

15 Claims, 6 Drawing Sheets

(51) Int. Cl.

| | |
|---|---|
| ***A24F 40/485*** | (2020.01) |
| ***A24F 40/51*** | (2020.01) |
| ***A24F 40/60*** | (2020.01) |

(56) References Cited

U.S. PATENT DOCUMENTS

| | | | | |
|---|---|---|---|---|
| 2014/0182608 | A1 | 7/2014 | Egoyants et al. | |
| 2014/0261488 | A1* | 9/2014 | Tucker | A24F 40/50 131/328 |
| 2014/0261492 | A1* | 9/2014 | Kane | A24F 40/485 131/328 |
| 2014/0262737 | A1* | 9/2014 | Shields | F03B 13/142 202/185.1 |
| 2015/0027470 | A1* | 1/2015 | Kane | A24F 40/485 131/328 |
| 2016/0193434 | A1 | 7/2016 | Gleixner et al. | |
| 2016/0213065 | A1* | 7/2016 | Wensley | A24F 40/48 |
| 2017/0000189 | A1 | 1/2017 | Mironov et al. | |
| 2017/0108210 | A1 | 4/2017 | Meinhart et al. | |
| 2018/0206552 | A1 | 7/2018 | Sebastian et al. | |
| 2018/0296778 | A1* | 10/2018 | Hacker | A24F 40/50 |
| 2018/0317557 | A1 | 11/2018 | Monsees et al. | |
| 2024/0245140 | A1* | 7/2024 | Warren | A24F 40/30 |
| 2024/0423293 | A1* | 12/2024 | Aw | A24F 40/70 |

FOREIGN PATENT DOCUMENTS

| | | | |
|---|---|---|---|
| JP | 2017500023 | A | 1/2017 |
| RU | 2675474 | C1 | 12/2018 |
| WO | 2013034456 | A1 | 3/2013 |
| WO | WO-2013131763 | A1 | 9/2013 |
| WO | 2017122196 | A1 | 7/2017 |
| WO | 2019115112 | A1 | 6/2019 |
| WO | 2019193209 | A1 | 10/2019 |
| WO | 2020182585 | A1 | 9/2020 |

OTHER PUBLICATIONS

"International Preliminary Report on Patentability for PCT Patent Application No. PCT/EP2020/083420, mailed on Jun. 9, 2022", 7 pages.

"Notice of Reasons for Rejection received for Japanese Patent Application No. 2022-530189, mailed on Aug. 29, 2023", 6 pages (3 pages of English Translation and 3 pages of Official Copy).

"Office Action received for Russian Patent Application No. 2022113765, mailed on May 24, 2024", 16 pages (8 pages of English Translation and 8 pages of Official Copy).

* cited by examiner

AEROSOLIZABLE MATERIAL FOR INSERTION INTO AN AEROSOL PROVISION DEVICE

RELATED APPLICATION INFORMATION

The present application is a National Phase entry of PCT Application No. PCT/EP2020/083420, filed Nov. 25, 2020, which claims priority from GB Patent Application No. 1917125.5, filed Nov. 25, 2019, each of which is hereby fully incorporated herein by reference.

TECHNICAL FIELD

The present invention relates to an aerosol provision device for heating aerosolizable material to produce an aerosol, and to an aerosol provision system comprising an article comprising aerosolizable material and an aerosol provision device.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first aspect of the present disclosure, there is provided an aerosol provision device for heating aerosolizable material to produce an aerosol. The device comprises a heating chamber configured to receive aerosolizable material, the heating chamber comprising an inlet and an outlet, an inlet valve associated with the inlet and an outlet valve associated with the outlet. The inlet valve and the outlet valves are moveable from a first configuration to a second configuration responsive to a change in a property of the heating chamber, In the first configuration the inlet valve and the outlet valves are arranged to seal the inlet and the outlet to substantially prevent gaseous flow through the inlet and the outlet. In the second configuration the inlet valve and the outlet valve are arranged to allow gaseous flow through the inlet and outlet.

According to a second aspect of the present disclosure, there is provided an aerosol provision system, comprising an article comprising aerosolizable material, and an aerosol provision device according to the first aspect.

Further features and advantages of the invention will become apparent from the following description of preferred embodiments of the invention, given by way of example only, which is made with reference to the accompanying drawings.

DETAILED DESCRIPTION

Figure 1:
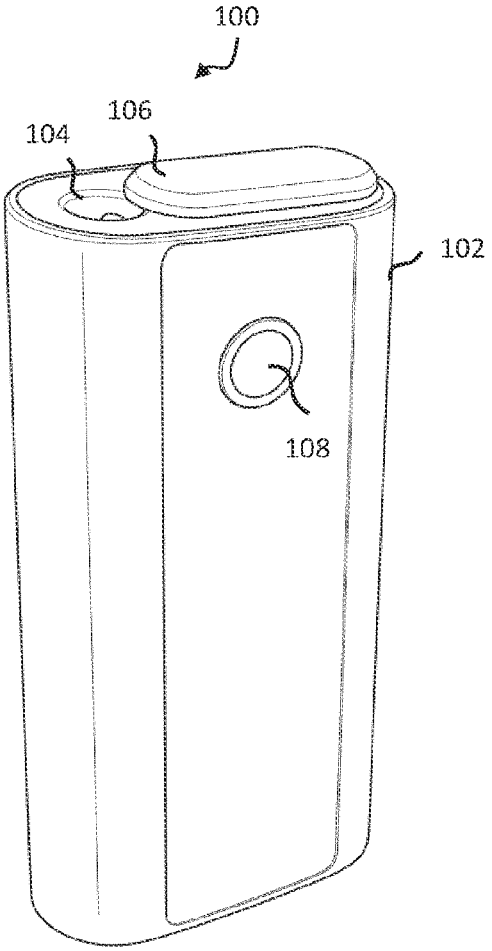
FIG. 1 shows a perspective view of an example of an aerosol provision device.

A first aspect of the present disclosure defines an aerosol provision device comprising a heating chamber which can receive aerosolizable material, such as tobacco, for heating. The aerosolizable material is insertable into the aerosol provision device and is heated to produce an aerosol which is subsequently inhaled by a user. The aerosolizable material may be, for example, of a predetermined or specific size that is configured to be placed within the heating chamber which is sized to receive the aerosolizable material. In one example, the aerosolizable material is tubular in nature, and may be known as a "tobacco stick", for example, the aerosolizable material may comprise tobacco formed in a specific shape which is then coated, or wrapped in one or more other materials, such as paper or foil. In another example, the aerosolizable material may be deposited on a flat substrate. In a specific example, the aerosolizable material is a solid or a gel. Aerosolizable material may also be known as smokable material.

The aerosolizable material may be deposited on a flat substrate and/or comprise a thin film. The aerosolizable material may comprise an aerosol former and/or a gelling agent.

In some embodiments, the aerosol former comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

The gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum.

In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In preferred embodiments, the non-cellulose based gelling agent is alginate or agar.

The aerosolizable material may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid.

The inclusion of an acid is particularly preferred in embodiments in which the aerosolizable material comprises nicotine. In such embodiments, the presence of an acid may stabilise dissolved species in the slurry from which the aerosolizable material is formed. The presence of the acid may reduce or substantially prevent evaporation of nicotine during drying of the slurry, thereby reducing loss of nicotine during manufacturing.

In certain embodiments, the aerosolizable material comprises a gelling agent comprising a cellulosic gelling agent and/or a non-cellulosic gelling agent, an active substance and an acid.

In some embodiments, the aerosolizable material comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The aerosolizable material may comprise one or more cannabinoid compounds selected from the group consisting of cannabidiol (CBD) and THC (tetrahydrocannabinol).

The aerosolizable material may comprise cannabidiol (CBD).

The aerosolizable material may comprise nicotine and cannabidiol (CBD).

The aerosolizable material may comprise nicotine, cannabidiol (CBD), and THC (tetrahydrocannabinol).

The aerosol provision device has an inlet and an outlet. Between the inlet and outlet is disposed a heating chamber comprising the aerosolizable material. The inlet is arranged to allow the passage of atmospheric air into the device, which mixes with aerosol formed in the heating chamber. The mixture of atmospheric air and aerosol can then flow out of the outlet, before being inhaled by a user. The aerosol provision device therefore comprises an air pathway extending between the inlet and outlet, which passes through the heating chamber.

The example aerosol provision device further comprises an inlet valve associated with the inlet, and an outlet valve associated with the outlet. Both valves are moveable between a first configuration and a second configuration responsive to a change in a property of the heating chamber. The property of the heating chamber may be at least one of: a temperature, a pressure, and an aerosol concentration, for example. In the first configuration the inlet and outlet valves are closed and therefore seal the inlet and outlet, respectively. Thus most or all of the air and/or aerosol cannot pass through the inlet or outlet. In the second configuration, the inlet and outlet valves are open to allow air and/or aerosol to pass through the inlet and outlet, respectively.

By allowing the valves to move between the first configuration and the second configuration responsive to a change in a property of the heating chamber, the efficiency of the heating process can be improved. In addition, this construction may prevent aerosol from escaping the heating chamber prematurely, which can diminish the user experience and waste some of the aerosolizable material.

The device therefore heats the aerosolizable material while the valves are closed, and when a change in a property of the heating chamber occurs, the valves can be opened. This means that a sealed volume of air is heated because air is not passing through the inlet, into the heating chamber, and out of the outlet. Heating can also occur after the valves have been opened. By sealing the heating chamber, heat loss can be reduced because heat is not being transferred and lost to a gaseous flow passing through the heating chamber in this initial heating phase. This allows the aerosolizable material to be heated more efficiently, which reduces energy consumption of the device. By heating the aerosol more efficiently, it will reach the desired temperature quicker, which reduces the time taken until a user can take a puff of the device. The aerosol being produced is substantially retained in the heating chamber until the valves are opened.

As briefly mentioned, the property of the heating chamber may be at least one of a temperature, a pressure, and an aerosol concentration. For example, the temperature of the aerosol, the valves, and/or the heating chamber may reach a predetermined temperature threshold. Above this temperature threshold, the inlet and outlet valves may be moveable between the first configuration and the second configuration. In another example, the aerosol pressure may reach a predetermined pressure threshold. Above this pressure threshold, the inlet and outlet valves may be moveable between the first configuration and the second configuration. In a further example, the aerosol concentration may reach a predetermined concentration threshold. Above this concentration threshold, the inlet and outlet valves may be moveable between the first configuration and the second configuration. In a particular case, the inlet and outlet valves may not be moveable from the first configuration to the second configuration until two or more of the above properties reach respective thresholds.

Optionally, a threshold may be a range, having a lower and upper value, rather than a specific value. The valves may open when the property goes above the lower value, and close if the property goes above the upper value. For example, if the property is temperature, the valves may be configured to close again if the temperature goes above an upper temperature. This may act as a safety feature by preventing a user's mouth from being burnt by hot aerosol. Closing the valves involves causing the inlet valve and the outlet valve to move from the second configuration to the first configuration.

The property thresholds may be customisable by a user, to suit their needs. For example, a user may be able to select a temperature, pressure and/or concentration above which the valves are openable. In another example, the property thresholds may be automatically chosen depending upon the type of aerosolizable material that is being aerosolised. For example, a user may select, or the device may detect, the type of aerosolizable material that is being heated. This can be useful if the particular aerosolizable material is required to be heated to a specific temperature that is different to other aerosolizable materials usable in the device.

The property thresholds may change during a smoking event, as the material is depleted. For example, the temperature, pressure, or concentration threshold may be configured to reduce over time as the aerosolizable material is being depleted. Additionally, or alternatively, the thresholds may change throughout the lifetime of the device, to compensate for a reduction of heater and/or battery efficiency, or to compensate for the heater and/or heating chamber becoming dirty.

In some examples the device is powered by a battery. The property thresholds may therefore depend upon the battery charge level. For example, if the battery level is low, and requires recharging, the heater may operate at a lower power level or on a lower duty cycle. The aerosol may therefore be at a lower temperature, pressure or concentration than it would be if the battery level was higher. To compensate, the property thresholds may also be lowered to ensure that the valves are configured to open despite this.

The aerosol provision device may comprise one or more actuators that are configured to open and/or close the inlet and outlet valves. The aerosol provision device may comprise one or more actuators comprising shape memory material, the one or more actuators being configured to cause the inlet valve and outlet valve to move from the first configuration to the second configuration when the shape memory material changes shape responsive to a stimulus. For example, the stimulus may be an application of a current or an application of heat. When the shape memory material changes shape, the change in shape may directly or indirectly cause the valves to open. There may be a single actuator which controls both the inlet and outlet valves, or there may be two actuators each of which operate a valve.

The shape memory material may be a shape memory alloy. For example, the shape memory alloy may change shape in response to the application of an electrical current or heat.

The opening and closing of the valves could be automatic. For example, the application of heat from the heating chamber and/or aerosol can cause the actuator to change shape without the need for a temperature sensor/and or electronic hardware to instruct the valves to open. Alternatively, a pressure activated switch could be activated by the aerosol, which subsequently causes a current to flow, thereby causing the valves to open.

In a specific example, the property is a temperature within the heating chamber, the one or more actuators are in thermal communication with the heating chamber, and the stimulus is heat from the heating chamber. Such a construction reduces the need for any processing of sensor data.

In other examples, the opening and closing may be controlled by electronic hardware. For example, electronic hardware may detect that the property satisfies a criterion and responsively provide a stimulus to cause the valves to open. The criterion may be satisfied when the property has reached a threshold, for example.

The aerosol provision device may comprise one or more wax actuators comprising wax, wherein the property of the heating chamber is the temperature, the one or more wax actuators being configured to cause the inlet valve and outlet valve to move from the first configuration to the second configuration when the wax changes phase. Again, this construction reduces the need for any processing of sensor data for the movement of the valves. When the wax changes phase, for example it melts, the wax changes shape. For example, the wax may expand upon application of heat.

The aerosol provision device may further comprise electronic hardware configured to determine that the property satisfies a criterion. For example, the electronic hardware may be configured to determine, calculate or estimate that the property satisfies a criterion. The criterion may be that the property exceeds a threshold, for example. The electronic hardware could be a controller, such as a processor, or other electronic circuitry which is capable of determining that the property satisfies a criterion.

In some examples, the electronic hardware does not cause or instruct the inlet and outlet valves to open. The electronic hardware may, for example, keep a record that the property satisfies the criterion and/or inform a user that the property satisfies the criterion.

In other examples however, the electronic hardware may be configured to cause the inlet valve and outlet valve to move from the first to second configurations. For example, the electronic hardware may instruct or cause actuators to open the valves when it has detected that the property satisfies the criterion. The electronic hardware may instruct or cause actuators to close the valves when it has detected that the property satisfies the criterion.

The aerosol provision device may further comprise a sensor to measure the property of the heating chamber as sensor data, wherein the electronic hardware causes the inlet valve and the outlet value to move from the first configuration to the second configuration based on the sensor data. For example, the device may comprise one or more temperature sensors, and/or one or more pressure sensors, and/or one or more sensors configured to determine an aerosol concentration. Data from the sensor(s) can be received by the electronic hardware where the sensor data can be analysed/processed/reviewed to determine whether the property satisfies a criterion based on the sensor data. If the criterion has been satisfied, the electronic hardware can cause the inlet and outlet valves to open. If the criterion is a threshold range, the electronic hardware can cause the inlet and outlet valves to close if the sensor data indicates that the upper value of the threshold has been reached.

The aerosol provision device may comprise a notification element configured to provide a notification that the change in the property satisfies the criterion. For example, the notification element may be a speaker, a light, or a motor, where these are configured to generate a sound, light or haptic feedback, respectively to indicate to a user that the change in the property satisfies the criterion. Accordingly, a user can be informed that the temperature, pressure, and/or concentration has reached a threshold. This can indicate to the user that they may operate the device. This can improve the user experience because the user is aware that they can open the valves.

In some examples, the inlet valve and outlet valve are moveable between the first and second configurations in response to a user input. For example, rather than automatically opening the valves when the property satisfies the criterion, a user can cause the valves to open themselves. This allows the user to control when the valves are opened and stops the aerosol being released if the user is not ready to take a puff of the device. Before the criterion is satisfied, the user input may be prevented from causing the valves to be operated.

The aerosol provision device may comprise a switch, wherein the user input is operation of the switch. For example, the switch may be a button or a capacitive sensor. The switch may be a dedicated switch, or it may serve one or more functions, such as operating the heater and causing the valves to open.

The aerosol provision device may comprise a puff sensor, wherein the user input comprises a detection of a user taking a puff by the puff sensor. This simplifies operation of the device by reducing the effort of the user. For example, the user does not need to press a switch before taking a puff but instead the puff sensor detects that the user is taking a puff and instructs the opening of the valves.

Figure 2:
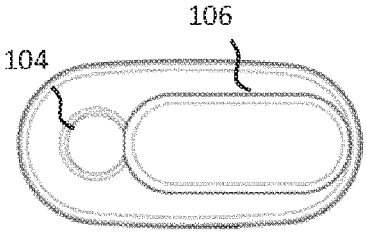
FIG. 2 shows a top view of the example aerosol provision device of FIG. 1.

Referring to FIG. 1, there is shown an example of an aerosol provision device 100. In broad outline, the device 100 may be used to heat an aerosolizable material (also referred to as a consumable, or article, or a consumable article, or smokable material) to generate an aerosol or other inhalable medium which is inhaled by a user of the device 100. FIG. 1 shows the device 100 without aerosolizable material inserted therein. FIG. 2 shows a top view of the device 100.

In FIGS. 1 and 2, the device 100 of this example comprises a housing 102. The housing 102 has an opening 104 in one end. The opening 104 can allow the passage of aerosol out of the device 100. In some examples, the opening 104 can receive aerosolizable material as it is inserted into a heating chamber. In other examples however, the aerosolizable material can be inserted into the heating chamber by a separate entrance. For example, a panel/door on the rear side of the device 100 can be opened to allow the material to be placed within the heating chamber. The material may be tobacco or other non-tobacco products, which may or may not contain nicotine and/or flavorants.

As used herein, the terms "flavor" and "flavorant" refer to materials which, where local regulations permit, may be used to create a desired taste or aroma in a product for adult consumers. In some embodiments the aerosol forming material may comprise a vapour or aerosol generating agent or a humectant, such as glycerol, propylene glycol, triacetin or diethylene glycol.

In use, an aerosol generating element is arranged to aerosolise the aerosolizable material to form an aerosol for user inhalation. In one example, the aerosol generating element is a heater arranged in use to heat the aerosolizable material, although it should be appreciated that other aerosol generating elements adapted to generate aerosol may equally be used in other examples.

The device 100 may comprise a mouthpiece (shown only in FIGS. 3 and 4) that is permanently or removably attached over the opening 104. A user can therefore draw the aerosol through the mouthpiece while taking a puff.

The device 100 may also comprise a cap 106, to cover the opening 104 when no aerosolizable material is in place. In FIGS. 1 and 2, the cap 106 is shown in an open configuration, however the cap 106 may slide into a closed configuration when the device 100 is not being used.

The device 100 may further comprise a control element 108. The control element 108 in this example is a button or a switch, and when a user activates the control element 108, the device 100 is switched on.

Figure 3:
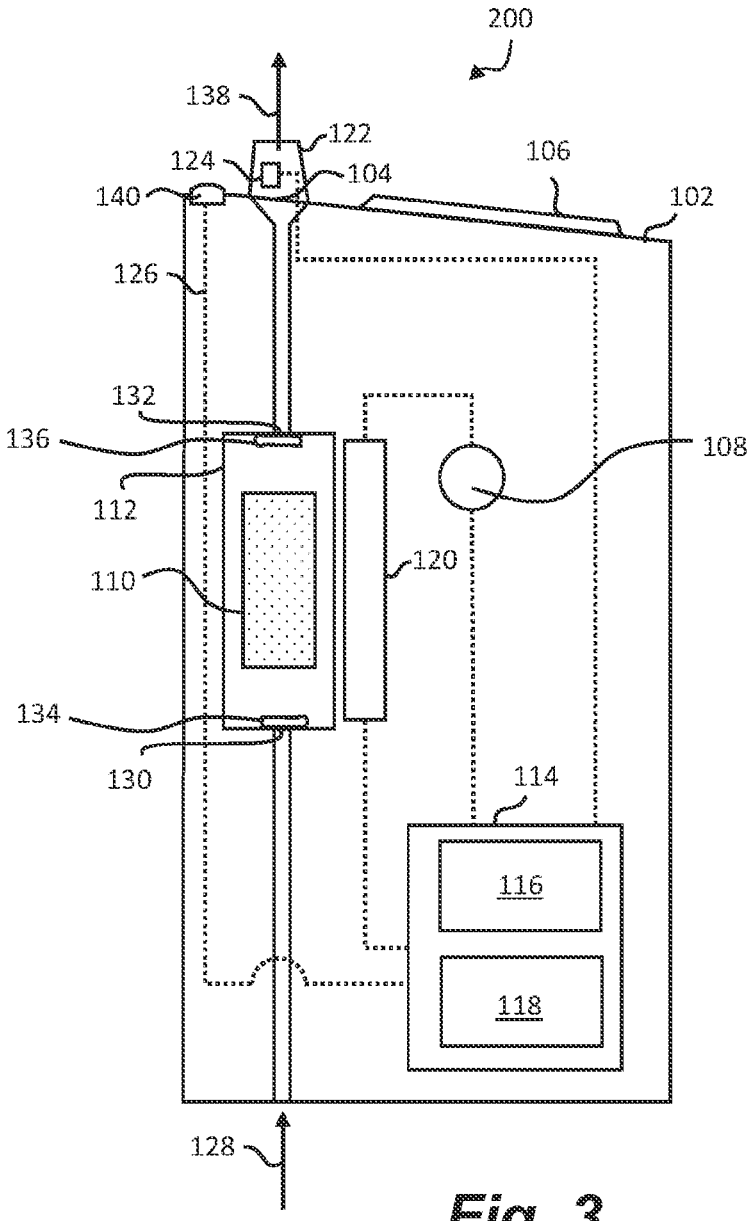
FIG. 3 shows a cross-sectional view of the example aerosol provision device of FIG. 1, where the inlet and outlet valves are arranged in a first configuration.

FIG. 3 shows a cross-sectional view of an example system 200 comprising the device 100, shown in FIG. 1, and aerosolizable material 110 which has been inserted into a receptacle, or heating chamber 112 where it is heated. The device 100 comprises one or more heaters 120 arranged to heat the aerosolizable material 110 once the aerosolizable material 110 has been received within the heating chamber 112. The aerosolizable material 110 therefore interacts with the heater 120 to generate an aerosol upon heating. The aerosolizable material 110 may be comprise one or more other elements, such as packaging materials and/or one or more filters.

The aerosolizable material 110 in this example is fully received within the heating chamber 112. In such a case, the user may inhale the aerosol directly from the opening 104, or via a mouthpiece 122 which may be connected to the housing 102 around the opening 104. In other examples an end of the aerosolizable material 110 may project out of the heating chamber 112 and/or device 100 through the opening 104 of the housing 102 such that user may inhale the aerosol through the aerosolizable material in use. In this particular example depicted in FIG. 3, the user may insert the aerosolizable material 110 into the chamber 112 via a separate entrance in the rear, side or front of the device (not shown). In other examples, however, the user may insert the aerosolizable material 110 into the chamber 112 via the opening 104 provided that the conduit is wide enough to receive the aerosolizable material 110.

The device 100 further has an electronics/power chamber 114 which in this example contains electronic hardware 116 and a power source 118. The electronic hardware 116 may be a controller, such as a microprocessor arrangement, configured and arranged to control the heating of the aerosolizable material. The electronic hardware 116 may receive a signal from the control element 108 and activate a heater 120 in response. As an alternative, the device 100 may comprise a puff sensor 124 that sends a signal to the electronic hardware 116 which in turn causes the heater 120 to be activated when a user is drawing on the device 100. Electronic elements within the device 100 are electrically connected via one or more wires 126, shown depicted as dashed lines.

The power source 118 may be a battery, which may be a rechargeable battery or a non-rechargeable battery. Examples of suitable batteries include for example a lithium-ion battery, a nickel battery (such as a nickel-cadmium battery), an alkaline battery and/or the like. The battery 118 is electrically coupled to one or more heaters 120 to supply electrical power when required to heat the aerosolizable material 110, and thereby generate an aerosol.

The heater 120 may be an electrically resistive heater, including for example a nichrome resistive heater, a ceramic heater, etc. The heater 120 may be an induction heater (which includes the arrangements of a susceptor in, or forming, the chamber 112, or a susceptor in the aerosolizable material 110). Other heating arrangements may be used.

The heater may comprise one or more electrically resistive heaters, including for example one or more nichrome resistive heater(s) and/or one or more ceramic heater(s). The one or more heaters may comprise one or more induction heaters which includes an arrangement comprising one or more susceptors which may form a chamber into which an article comprising aerosolizable material is inserted or otherwise located in use. Alternatively or in addition, one or more susceptors may be provided in the aerosolizable material. Other heating arrangements may also be used.

As mentioned, the heating chamber 112 contains the aerosolizable material 110 while it is being heated by the heater 120. The heating chamber 112 comprises an inlet 130, through which atmospheric air can pass. For example, the atmospheric air from outside of the device 100 flows into the device 100, along a conduit, and through the inlet 130 and into the heating chamber 112. Gaseous flow into the device 100 is indicated by the arrow 128. Similarly, the heating chamber 112 comprises an outlet 132, through which aerosol can pass. For example, the atmospheric air mixes with aerosol formed within the heating chamber 112, which flows through the outlet 132, along a conduit and out of the device 100 via the opening 104 and mouthpiece 122. Gaseous flow out of the device 100 is indicated by the arrow 138.

The device 100 further comprises an inlet valve 134 associated with the inlet 130 and an outlet valve 136 associated with the outlet 132. These valves 134, 136 are configured to seal the inlet 130 and the outlet 132 while positioned in a first configuration, shown in FIG. 3. This first configuration may also be called a closed configuration because the valves 134, 136 are closed. When the valves 134, 136 are closed, the valves 134, 136 seal/block the inlet 130 and the outlet 132 to prevent gaseous flow through the inlet 130 and the outlet 132. In this first configuration, the atmospheric air cannot flow into the heating chamber 112 and aerosol produced in the heating chamber 112 cannot flow out of the heating chamber 112. In examples where an end of the aerosolizable material 110 projects out of the heating chamber 112, the outlet valve 136 may seal around the aerosolizable material 110.

Figure 4:
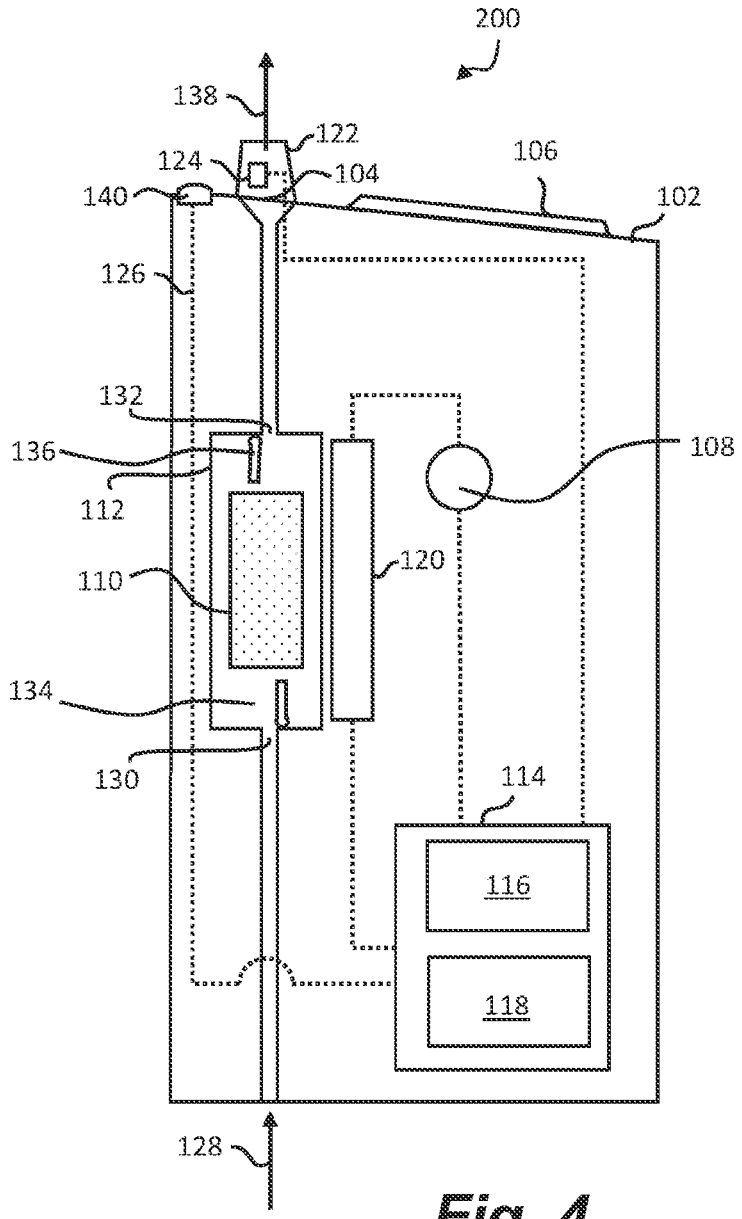
FIG. 4 shows a cross-sectional view of the example aerosol provision device of FIG. 3, where the inlet and outlet valves are arranged in a second configuration.

FIG. 4 shows the system 200, shown in FIG. 3, with the inlet valve 134 and the outlet valve 136 arranged in a second configuration. This second configuration may also be called an open configuration because the valves 134, 136 are open. When the valves 134, 136 are open, the valves 134, 136 do not seal/block the inlet 130 and the outlet 132, so they allow the gaseous flow through the inlet 130 and the outlet 132. In this second configuration, the atmospheric air can flow into the heating chamber 112 and aerosol produced in the heating chamber 112 can flow out of the heating chamber 112.

As mentioned previously, the valves 134, 136 are moveable between a first configuration and a second configuration responsive to a change in a property of the heating chamber 112. The property of the heating chamber 112 may be, for example, at least one of: a temperature, a pressure, and an aerosol concentration, for example. The valves 134, 136 depicted in FIGS. 3 and 4 are shown schematically, for illustrative purposes. The valves 134, 136 may operate differently to those depicted. Certain detailed examples will be described in the examples of FIGS. 5-7.

Figure 5:
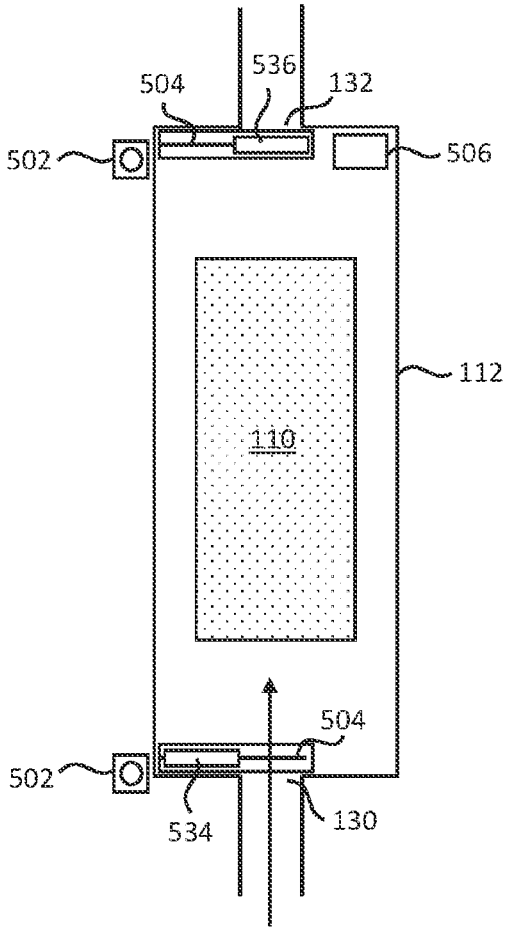
FIG. 5 shows a cross-sectional view of a portion of an aerosol provision device according to an example.

FIG. 5 shows a cross-sectional view of a portion of the aerosol provision device 100, according to a first example. Other features of the device 100 are omitted for clarity. The device may comprise any or all of the features described in relation to FIGS. 1-4.

FIG. 5 depicts aerosolizable material 110 received within the heating chamber 112. In this example, the inlet valve 534 is shown in an open configuration, so that atmospheric air flows into the heating chamber 112, via the inlet 130. The outlet valve 536 is shown in a closed configuration, so that aerosol cannot flow out of the heating chamber 112, via the outlet 132. In most circumstances the inlet valve 534 and the outlet valve 536 will both be arranged in the same configuration, however for explanatory purposes, the valves 534, 536 are shown arranged in different configurations.

In this example, movement of the valves 534, 536 is facilitated by two separate actuators. The actuators may be linear actuators, for example. The actuators are configured to move the valves 534, 536 between the open and closed configurations. The actuators each comprise a motor 502 and a track 504. The motor 502 may be a rotational motor which generates rotational motion, which is converted into linear motion to move the valves 534, 536 along the track 504. In another example, the motor 502 may be a linear motor which generates linear motion, which moves the valves 534, 536 along the track 504. The linear motor may also move along the track 504. By operating the actuators, the valves 534, 536 can be opened and closed.

In the example of FIG. 5, the actuators are configured to operate in response to an instruction received from the electronic hardware 116, via a connection 126 (not shown in FIG. 5). The device 100 further comprises a sensor 506, which can measure a property of the heating chamber 112.

The sensor 506 may be a temperature sensor which is in thermal communication with the heating chamber 112. The temperature sensor may be positioned within the heating chamber 112 or outside of the heating chamber. When positioned within the heating chamber 112, the temperature sensor may measure the temperature of the aerosol and/or an inner surface of the heating chamber 112. When positioned outside of the heating chamber 112, the temperature sensor may measure the temperature of an outer surface of the heating chamber 112.

The sensor 506 may be a pressure sensor which is arranged to directly or indirectly measure the pressure of the aerosol formed within the heating chamber 112. The pressure sensor may be positioned within the heating chamber 112 or outside of the heating chamber. When positioned within the heating chamber 112, the pressure sensor may directly measure the pressure of the aerosol. When positioned outside of the heating chamber 112, the pressure sensor may indirectly measure the pressure the aerosol. For example, the walls of the heating chamber 112 may expand outwardly when the aerosol pressure increases within the heating chamber 112. This expansion may be detectable outside of the heating chamber 112 by a sensor, for example by measuring a change in the strain in the wall of the heating chamber 112.

The sensor 506 may be an aerosol concentration sensor which is arranged to measure the concentration of the aerosol formed within the heating chamber 112. This sensor may be positioned within the heating chamber 112.

Regardless of the type of sensor 506 being used, the sensor 506 generates sensor data. The sensor data is relayed back to the electronic hardware 116, via the connection 126. Once received, the electronic hardware 116 can detect, calculate or determine whether the measured property satisfies a criterion. For example, the sensor data may indicate that the property exceeds a predetermined threshold.

In some examples, if the electronic hardware 116 determines that the criterion has been satisfied, it can send an instruction to the actuators to cause the valves 534, 536 to be opened. However, in other examples the electronic hardware 116 may not immediately send the instruction to the actuators to cause the valves 534, 536 to be opened. Instead, the electronic hardware 116 may await user input before sending the instruction. For example, the puff sensor 124 (shown in FIGS. 3 and 4) may send a signal to the electronic hardware 116, via a connection 126, to indicate that the user is taking a puff on the device 100. Upon receipt of the signal from the puff sensor 124, the electronic hardware 116 may send the instruction to the actuators. In another example, the user may operate a switch or button, such as switch 108, to indicate that they wish for the valves 534, 536 to be opened. The electronic hardware 116 may detect that a user is operating the switch and therefore sends the instruction to the actuators.

In one example, if the electronic hardware 116 determines that the criterion has been satisfied, it can send an instruction to a notification element 140 (shown in FIGS. 3 and 4) to notify the user that the criterion has been satisfied. The notification element 140 may be an LED or a speaker for example. The user, upon being notified, may thus provide the user input to cause the valves 534, 536 to be opened.

Alternatively, if the valves 534, 536 have already been opened, the user knows that they can use the device.

Figure 6:
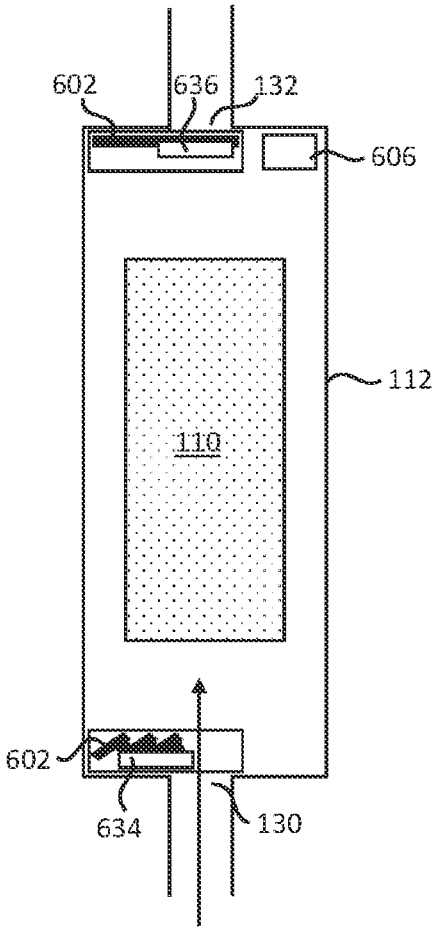
FIG. 6 shows a cross-sectional view of a portion of an aerosol provision device according to another example.

FIG. 6 shows a cross-sectional view of a portion of the aerosol provision device 100, according to a second example. Other features of the device 100 are omitted for clarity. The device may comprise any or all of the features described in relation to FIGS. 1-4.

FIG. 6 depicts aerosolizable material 110 received within the heating chamber 112. In this example, the inlet valve 634 is shown in an open configuration, so that atmospheric air flows into the heating chamber 112, via the inlet 130. The outlet valve 636 is shown in a closed configuration, so that aerosol cannot flow out of the heating chamber 112, via the outlet 132. In most circumstances the inlet valve 634 and the outlet valve 636 will both be arranged in the same configuration, however for explanatory purposes, the valves 634, 636 are shown arranged in different configurations.

In this example, movement of the valves 634, 636 is facilitated by two separate actuators. The actuators comprise shape memory material 602. The actuators are configured to move the valves 634, 636 between the open and closed configurations. The shape memory material 602 is configured to change shape responsive to a stimulus, such as the application of a current or heat.

In this example, the valves 634, 636 are attached or connected to the shape memory material 602, and movement of the shape memory material 602 causes movement of the valves 634, 636. In other examples however, the valves 634, 636 themselves may be partially or fully formed of shape memory material 602.

The outlet valve 636 is depicted as being in the closed configuration. Upon application of a stimulus to the shape memory material 602, the shape memory material 602 changes shape. The shape memory material 602 attached to the outlet valve 636 is initially shown as being flat. After the application of the stimulus, the shape memory material 602 may change to a different shape. The shape memory material 602 attached to the inlet valve 634 is shown as being reduced in length, for example by adopting a curled, a folded or a crumpled shape. This change of shape moves the valve 634, 636 to the open configuration.

As mentioned, the actuators are configured to operate in response to a stimulus. The stimulus could be applied as a result of the electronic circuitry 116 causing the stimulus to be applied. For example, the device 100 may comprise a sensor 606, which can measure a property of the heating chamber 112. The sensor 606 may be substantially the same as the sensor 506 described in FIG. 5. The sensor data may be relayed back to the electronic hardware 116, via a connection 126. Once received, the electronic hardware 116 can detect, calculate or determine whether the measured property satisfies a criterion. For example, the sensor data may indicate that the property exceeds a predetermined threshold.

If the electronic hardware 116 determines that the criterion has been satisfied, it can send an instruction to cause a stimulus to be applied to the shape memory material 602. For example, a current can be applied to cause the shape memory material 602 to change shape, which causes the valves 634, 636 to be opened. Suitable shape memory materials 602 can include a shape memory alloy, such as a nickel-titanium alloy.

In other examples the electronic hardware 116 may not immediately cause the stimulus to be applied. Instead, the electronic hardware 116 may await user input before sending the instruction. For example, the puff sensor 124 (shown in FIGS. 3 and 4) may send a signal to the electronic hardware 116, via a connection 126, to indicate that the user is taking a puff on the device 100. Upon receipt of the signal from the puff sensor 124, the electronic hardware 116 may cause the stimulus to be applied. In another example, the user may operate a switch or button, such as switch 108, to indicate that they wish for the valves 634, 636 to be opened. The electronic hardware 116 may detect that a user is operating the switch and therefore cause the stimulus to be applied.

Some examples may include a reset actuator or other means of reset to cause the shape memory material to return to the configuration where the valve is closed.

Figure 7:
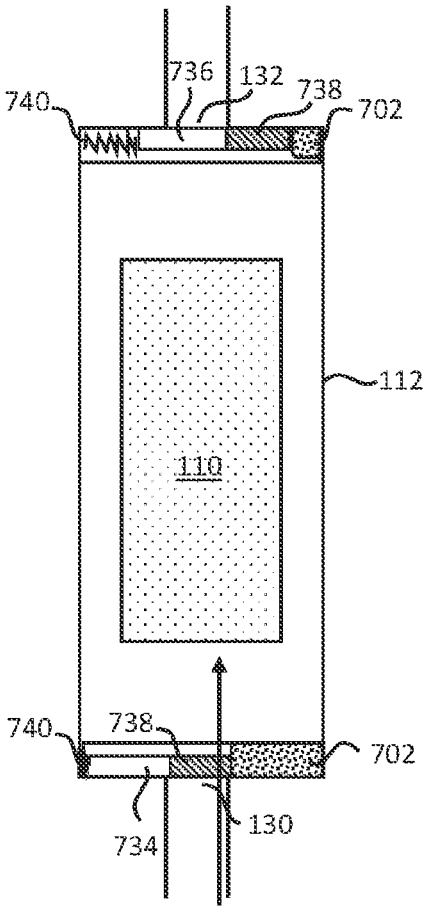
FIG. 7 shows a cross-sectional view of a portion of an aerosol provision device according to a further example.

FIG. 7 shows a cross-sectional view of a portion of the aerosol provision device 100, according to a third example. Other features of the device 100 are omitted for clarity. The device may comprise any or all of the features described in relation to FIGS. 1-4.

FIG. 7 depicts aerosolizable material 110 received within the heating chamber 112. In this example, the inlet valve 734 is shown in an open configuration, so that atmospheric air flows into the heating chamber 112, via the inlet 130. The inlet valve 734 has an aperture 738, which is aligned with the inlet 130, and the atmospheric air passes through the aperture 738 in the inlet valve 734. The outlet valve 736 is shown in a closed configuration, so that aerosol cannot flow out of the heating chamber 112, via the outlet 132. Again, the outlet valve 736 has an aperture 738, however the aperture 738 is not aligned with the outlet 132, so aerosol cannot pass through the outlet 132. In most circumstances the inlet valve 734 and the outlet valve 736 will both be arranged in the same configuration, however for explanatory purposes, the valves 734, 736 are shown arranged in different configurations.

In this example, movement of the valves 734, 736 is facilitated by two separate wax actuators. The wax actuators comprise wax 702. The actuators are configured to move the valves 734, 736 between the open and closed configurations. The wax 702 is configured to change phase, and therefore change shape, responsive the application heat. In this example, the valves 734, 736 engage the wax 602, and movement of the wax 702 causes movement of the valves 734, 736 and therefore movement of the aperture 738.

The outlet valve 736 is depicted as being in the closed configuration because the outlet 132 and the aperture 738 are not aligned. Upon application of heat to the wax 702, the wax 702 changes phase, for example it melts. The change of phase causes the wax 702 to expand. The wax 702 attached to the outlet valve 736 is initially shown as occupying a certain volume within the actuator. After the application of heat, the wax 702 may expand and urge the valve 736 against a bias provided by a spring 740 or another form of resilient element. The spring 740 biases the valve towards the closed position. The wax 702 attached to the inlet valve 734 is shown as occupying a larger volume, due to the expansion. This expansion moves the valves 734, 736 to the open configuration by causing the aperture 738 and the inlet 130 to be aligned. In this open configuration the spring 740 is compressed.

As mentioned, the actuators are configured to operate in response to the application of heat. This heat may be transferred to the wax 702 from the aerosol and/or the heating chamber 112. The wax actuators therefore act automatically, without the need for instruction from electronic circuitry 116.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol provision device for heating aerosolizable material to produce an aerosol, the device comprising:

a heating chamber configured to receive aerosolizable material, the heating chamber comprising an inlet and an outlet;

an inlet valve associated with the inlet; and an outlet valve associated with the outlet;

wherein:

the inlet valve and the outlet valve are moveable from a first configuration to a second configuration responsive to a change in a property of the heating chamber, wherein:

in the first configuration the inlet valve and the outlet valve are arranged to seal the inlet and the outlet to substantially prevent gaseous flow through the inlet and the outlet; and in the second configuration the inlet valve and the outlet valve are arranged to allow gaseous flow through the inlet and outlet.

2. An aerosol provision device according to claim 1, wherein the property of the heating chamber is at least one of:

a temperature;

a pressure; and an aerosol concentration.

3. An aerosol provision device according to claim 1, further comprising one or more actuators comprising shape memory material, the one or more actuators being configured to cause the inlet valve and outlet valve to move from the first configuration and to the second configuration when the shape memory material changes shape responsive to a stimulus.

4. An aerosol provision device according to claim 3, wherein the stimulus is an application of a current or an application of heat.

5. An aerosol provision device according to claim 3, wherein the shape memory material is a shape memory alloy.

6. An aerosol provision device according to claim 3, wherein the property is a temperature within the heating chamber, the one or more actuators are in thermal communication with the heating chamber, and the stimulus is heat from the heating chamber.

7. An aerosol provision device according to claim 1, further comprising one or more wax actuators comprising wax, wherein the property of the heating chamber is the temperature, the one or more wax actuators being configured to cause the inlet valve and outlet valve to move from the first configuration to the second configuration when the wax changes phase.

8. An aerosol provision device according to claim 1, further comprising a sensor to measure the property of the heating chamber as sensor data, wherein the inlet valve and the outlet valve are movable from a first configuration to a second configuration based on the sensor data.

9. An aerosol provision device according to any of claim 8, wherein the inlet valve and outlet valve are moveable between the first and second configurations in response to a user input.

10. An aerosol provision device according to claim 1, wherein the device comprises a notification element configured to provide a notification based on the change in the property of the heating chamber.

11. An aerosol provision device according to claim 1, wherein the aerosolizable material is a solid or a gel.

12. An aerosol provision device according to claim 1, wherein an air pathway extends between the inlet and the outlet and passes through the heating chamber.

13. An aerosol provision system, comprising:

an article comprising aerosolizable material; and the aerosol provision device according to claim 1.

14. An aerosol provision device according to claim 9, further comprising a puff sensor, wherein the user input comprises a detection of a user taking a puff by the puff sensor.

15. An aerosol provision device according claim 9, further comprising a switch, wherein the user input is operation of the switch.

* * * * *